US007500470B2

(12) United States Patent
Buslepp et al.

(10) Patent No.: US 7,500,470 B2
(45) Date of Patent: Mar. 10, 2009

(54) CYLINDER TORQUE BALANCING FOR INTERNAL COMBUSTION ENGINES

(75) Inventors: Kenneth J. Buslepp, Brighton, MI (US); Douglas R. Verner, Sterling Heights, MI (US); Randall J. Guild, Okemos, MI (US); David S. Mathews, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 286 days.

(21) Appl. No.: 11/432,446

(22) Filed: May 11, 2006

(65) Prior Publication Data

US 2007/0261669 A1 Nov. 15, 2007

(51) Int. Cl.
*F02D 41/14* (2006.01)

(52) U.S. Cl. ..... 123/436; 123/673

(58) Field of Classification Search ..... 123/436, 123/673

See application file for complete search history.

(56) References Cited

U.S. PATENT DOCUMENTS

| | | | | |
|---|---|---|---|---|
| 5,385,129 | A * | 1/1995 | Eyberg | 123/436 |
| 5,701,865 | A * | 12/1997 | Thomas et al. | 123/339.11 |
| 5,720,260 | A * | 2/1998 | Meyer et al. | 123/436 |
| 5,906,652 | A * | 5/1999 | Remboski et al. | 123/436 |
| 6,024,070 | A * | 2/2000 | May et al. | 123/436 |
| 6,209,519 | B1 * | 4/2001 | Melchior et al. | 123/436 |
| 6,993,427 | B2 * | 1/2006 | Ueda | 123/436 |
| 7,027,910 | B1 * | 4/2006 | Javaherian et al. | 123/673 |

* cited by examiner

*Primary Examiner*—Erick Solis

(57) ABSTRACT

An engine torque control system for balancing torque output across cylinders of an internal combustion engine includes a first module that determines a derivative term for each cylinder of the engine based on rotation of a crankshaft. A second module determines a torque correction for a first cylinder based on an average derivative term associated with the first cylinder. The second module adjusts a torque output of the first cylinder based on the torque correction and adjusts a torque output of a second cylinder based on the torque correction.

37 Claims, 5 Drawing Sheets

CYLINDER TORQUE BALANCING FOR INTERNAL COMBUSTION ENGINES

FIELD OF THE INVENTION

The present invention relates to internal combustion engines, and more particularly to balancing torque across cylinders of an internal combustion engine.

BACKGROUND OF THE INVENTION

Internal combustion engines create drive torque that is transferred to a drivetrain via a crankshaft. More specifically, air is drawn into an engine and is mixed with fuel therein. The air and fuel mixture is combusted within cylinders to drive pistons. The pistons drive the crankshaft, generating drive torque.

In some instances, the individual cylinders do not produce an equivalent amount of drive torque. That is to say, some cylinders can be weaker than others, resulting in a torque imbalance across the cylinders. Such torque imbalances can generate noticeable vibrations throughout the drivetrain and can even result in engine stall if severe enough. Although traditional torque balance systems identify and increase the torque output to a chronically weak cylinder, such system fail to account for the torque increase and fail to balance the torque output across all cylinders.

SUMMARY OF THE INVENTION

Accordingly, the present invention provides an engine torque control system for balancing torque output across cylinders of an internal combustion engine. The engine torque control system includes a first module that determines a derivative term for each cylinder of the engine based on rotation of a crankshaft and a second module that determines a torque correction for a first cylinder based on an average derivative term associated with the first cylinder. The second module adjusts a torque output of the first cylinder based on the torque correction and adjusts a torque output of a second cylinder based on the torque correction.

In one feature, the second module compares the average derivative term to a derivative term threshold and adjusts the torque output when the average derivative term exceeds the derivative term threshold.

In another feature, the engine torque control system further includes a third module that determines a first derivative based on the rotation of the crankshaft and a fourth module that determines a second derivative based on the first derivative. The average derivative term is determined based on the first and second derivatives.

In another feature, the average derivative term is determined based on a first derivative that is determined for the first cylinder, a second derivative that is determined for the first cylinder and another second derivative that is determined for a recovery cylinder that is immediately after the first cylinder in a firing order.

In other features, the second module adjusts the torque output by increasing a torque output of the first cylinder. The torque output of the second cylinder is decreased in correspondence with a torque increase of the first cylinder.

In another feature, the second module increases a torque output of the first cylinder by an increase torque amount, decreases a torque output of the second cylinder by a first decrease torque amount and decreases a torque output of a third cylinder by a second decrease torque amount. A total of the first and second decrease torque amounts corresponds to the increase torque amount.

In still other features, the second module calculates a spark timing based on the average derivative term and induces combustion in the first cylinder based on the spark timing. The spark timing is further based on a spark versus thermal efficiency curve of the engine.

In yet another feature, the second module adjusts the torque output by regulating a fueling rate to the first cylinder.

In another aspect, the present invention provides an engine torque control system that balances torque output across cylinders of an internal combustion engine and includes a first module that determines a derivative term for each cylinder of the engine based on rotation of a crankshaft and a second module that determines an average derivative term for each cylinder. The second module adjusts a torque output of the cylinders based on their respective average derivative terms to balance the average derivative terms with respect to one another.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
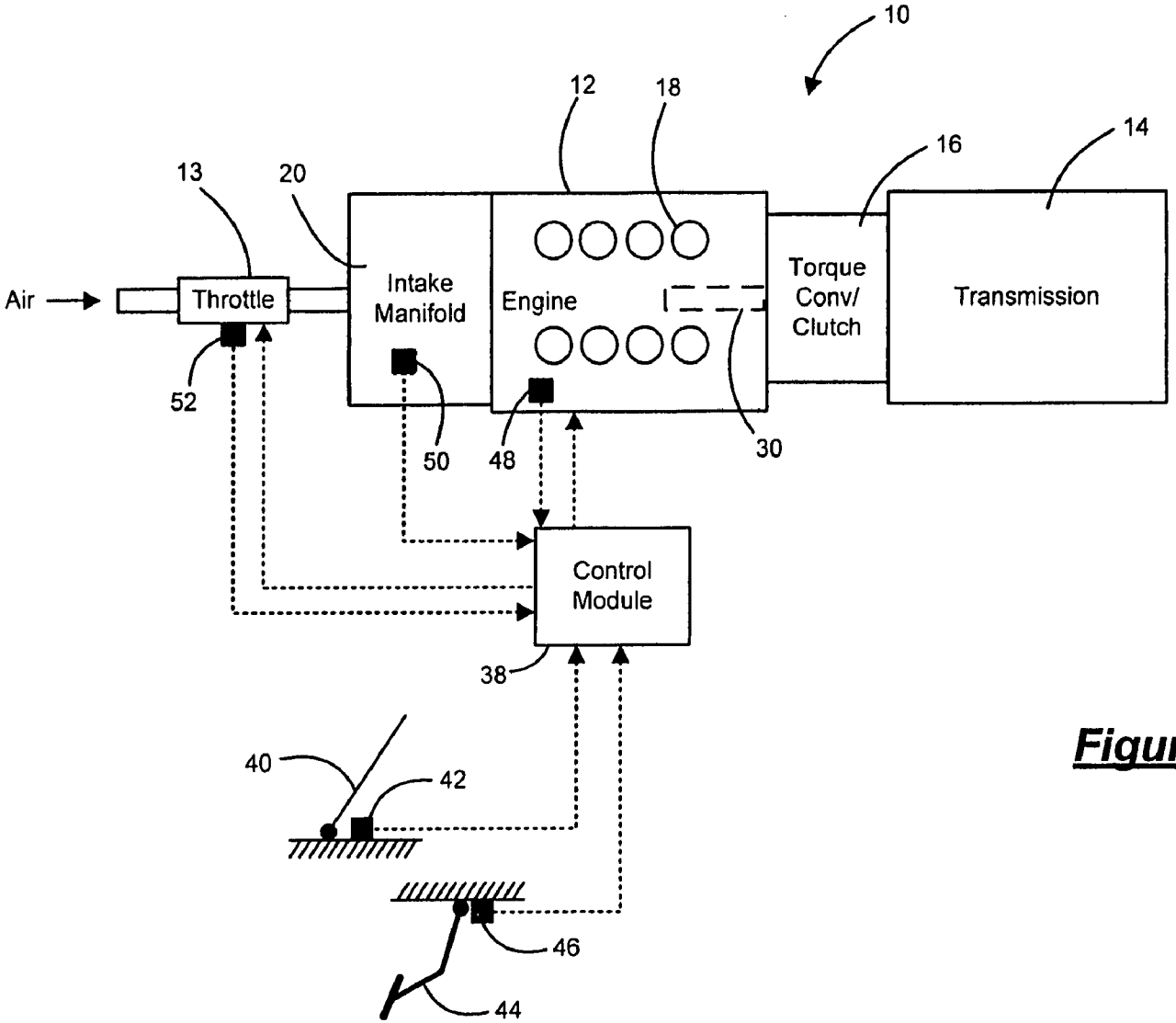
FIG. 1 is a functional block diagram illustrating an exemplary vehicle that is regulated based on the cylinder torque balancing control of the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an exemplary vehicle 10 includes an engine 12 that drives a transmission 14. The transmission 14 is either an automatic or a manual transmission that is driven by the engine 12 through a corresponding torque converter or clutch 16. Air flows into the engine 12 through a throttle 13. The engine 12 includes N cylinders 18. Although FIG. 1 depicts eight cylinders (N=8), it is appreciated that the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18. The combustion process reciprocally drives pistons (not shown) within the cylinders 18. The pistons rotatably drive a crankshaft 30 to provide drive torque to the powertrain.

A control module 38 communicates with the engine 12 and various inputs and sensors as described herein. A vehicle operator manipulates an accelerator pedal 40 to regulate the throttle 13. More particularly, a pedal position sensor 42 generates a pedal position signal that is communicated to the control module 38. The control module 38 generates a throttle control signal based on the pedal position signal. A throttle actuator (not shown) adjusts the throttle 13 based on the throttle control signal to regulate airflow into the engine 12.

The vehicle operator manipulates a brake pedal 44 to regulate vehicle braking. More particularly, a brake position sensor 46 generates a brake pedal position signal that is communicated to the control module 38. The control module 38 generates a brake control signal based on the brake pedal position signal. A brake system (not shown) adjusts vehicle braking based on the brake control signal to regulate vehicle speed. An intake manifold absolute pressure (MAP) sensor 50 generates a signal based on a pressure of the intake manifold 20. A throttle position sensor (TPS) 52 generates a signal based on throttle position.

A crankshaft rotation sensor 48 generates a signal based on rotation of the crankshaft 30, which can be used to calculate engine speed. More specifically, the engine includes a crankshaft rotation mechanism (not shown), to which the crankshaft rotation sensor 48 is responsive. In one example, the crankshaft rotation mechanism includes a toothed wheel that is fixed for rotation with the crankshaft 30. The crankshaft rotation sensor 48 is responsive to the rising and falling edges of the teeth. An exemplary toothed wheel includes 58 teeth that are equally spaced about the circumference of the wheel, except in one location where two teeth are missing to provide a gap. Therefore, the gap accounts for approximately 12° of crankshaft rotation and each tooth accounts for approximately 6° of crankshaft rotation. The control module 38 determines the engine RPM based on the time it takes for a pre-determined number of teeth to pass.

The cylinder torque balancing control of the present invention identifies weak cylinders based on rotation of the crankshaft and balances the cylinder torque output across the cylinders. More specifically, the cylinder torque balancing control monitors the crankshaft signal generated by the crankshaft rotation sensor 48. The time it takes the crankshaft 30 to rotate a predetermined angle (e.g., 90°) during the expansion stroke of a particular cylinder is provided as $t_{CS}$.

An average derivative term ($DT_{AVG}$) for each cylinder is calculated. $DT_{AVG}$ is determined based on first and second crankshaft speed derivatives FD and SD, respectively. More specifically, FD is determined for the monitored cylinder k-1 and is denoted $FD_{k-1}$. As used herein, k is the recovery cylinder, which fires after the monitored cylinder k-1 (i.e., the recovery cylinder is next in the firing order after the monitored cylinder). SD is determined for both the recovery cylinder (i.e., the currently firing cylinder) and the monitored cylinder, which are provided as $SD_k$ and $SD_{k-1}$, respectively. A derivative term (DT) for a particular cylinder is sampled over several engine cycles and $DT_{AVG}$ is determined as the average thereof.

If $DT_{AVG}$ of a particular cylinder exceeds a threshold ($DT_{THR}$), that cylinder is deemed weak. Accordingly, the torque output of the particular cylinder ($TQ_k$) is increased. Concurrently, the torque output of another cylinder or other cylinders is correspondingly decreased. That is to say, if the torque output of the weak cylinder is increased by X Nm, the torque output of another cylinder is decreased by X Nm. Alternatively, the torque output of each of a plurality of other cylinders can be decreased, whereby the total torque output decrease is equal to X Nm.

In another aspect of the present invention, the cylinder torque balancing control can actively balance the torque output of each cylinder with respect to the total torque output across the cylinders. More specifically, the cylinder torque balancing control monitors $DT_{AVG}$ for each cylinder and increases or decreases the torque output of the individual cylinders to balance $DT_{AVG}$ across the cylinders. $DT_{AVG}$ can be balanced so that it is approximately equal for all cylinders. Alternatively, $DT_{AVG}$ can be balanced so that each $DT_{AVG}$ is within a predetermined range. That is to say that $DT_{AVG}$ is within a range defined between a predetermined minimum DT ($DT_{MIN}$) and a predetermined maximum DT ($DT_{MAX}$).

The torque output of the individual cylinders can be regulated by adjusting the spark timing of the particular cylinder. More specifically, the spark timing can be retarded or advanced to respectively decrease and increase the torque output of the particular cylinder. The spark versus thermal efficiency curve for the particular engine can be implemented to determine the spark adjustment to achieve the desired torque adjustment. If an engine exhibits a steep relationship of spark timing to thermal efficiency, a pure spark correction will vary in delivered torque as a function of the base spark timing. For example, the torque versus spark timing slope is different at 8° base spark timing when compared to 15° timing. In the case of a diesel engine, the torque output can be regulated by adjusting the fueling to the particular cylinder, whereby the fuel to torque relationship is used to determine the fuel adjustment required to achieve the desired torque change.

Figure 2:
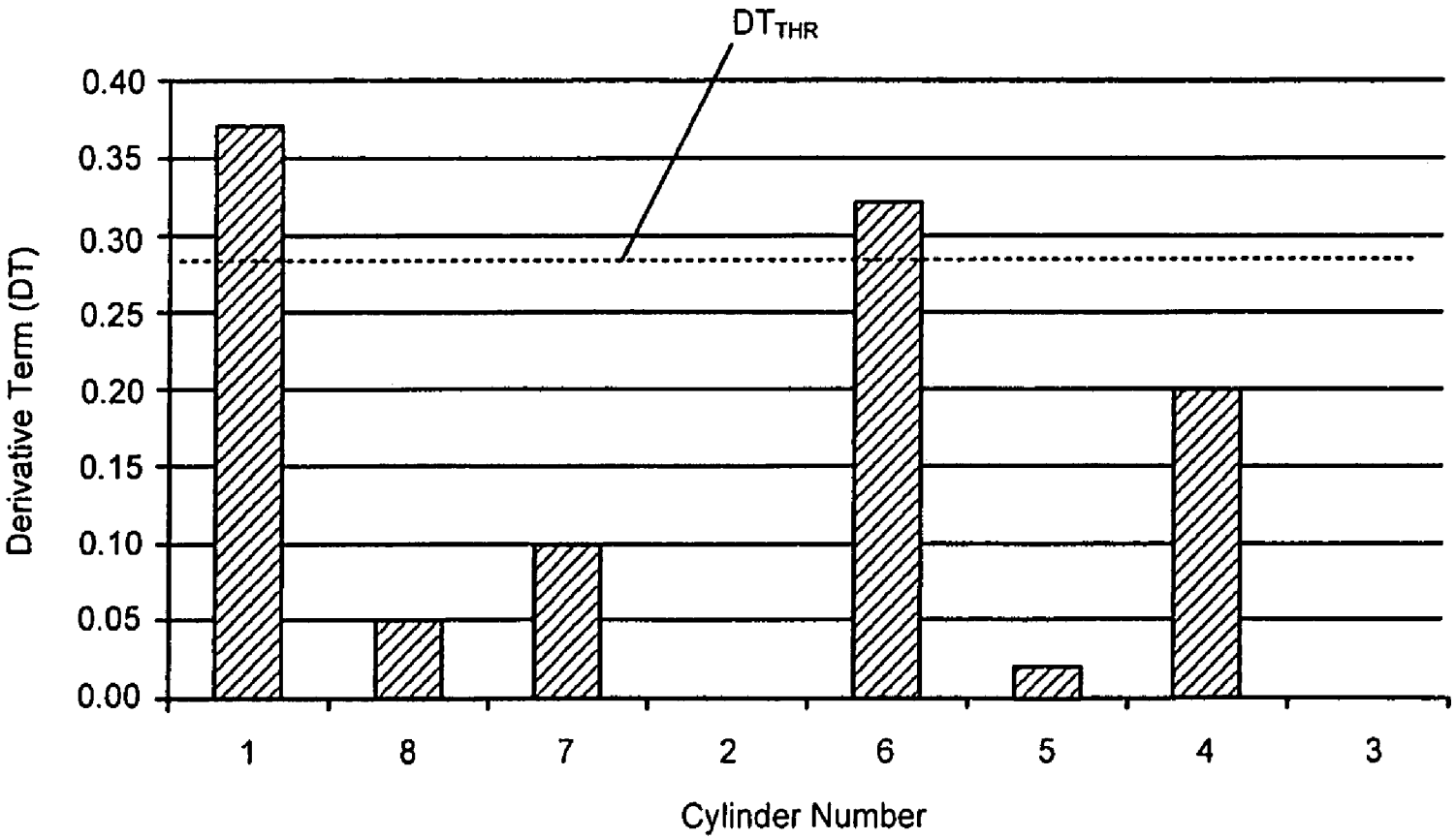
FIG. 2 is a graph illustrating exemplary derivative term magnitudes for cylinders of the exemplary engine system of FIG. 1, which are determined based on the cylinder torque balancing control of the present invention.

Referring now to FIG. 2, a graph illustrates exemplary $DT_{AVG}$ traces for cylinders in an 8-cylinder engine. It should be noted that the cylinder numbers (CN) along the x-axis are listed in their firing order. For example, if CN6 is the currently monitored cylinder k-1, CN2 is the previously fired cylinder k-2 and CN5 is the next firing or recovery cylinder k. As illustrated, $DT_{AVG}$ for CN6 exceeds $DT_{THR}$. Accordingly, the torque output of CN6 is increased and the torque output of a corresponding cylinder or cylinders (i.e., adjacent cylinder or cylinders in the firing order) is correspondingly decreased during the subsequent engine cycle. For example, the torque output of either CN2 or CN5 can be decreased. Alternatively, the total torque output of CN2 and CN5 can be decreased. In this case, the torque output of CN2 can be decreased by a greater amount than the torque output of CN5 because $DT_{AVG}$ for CN5 is greater.

Figure 3:
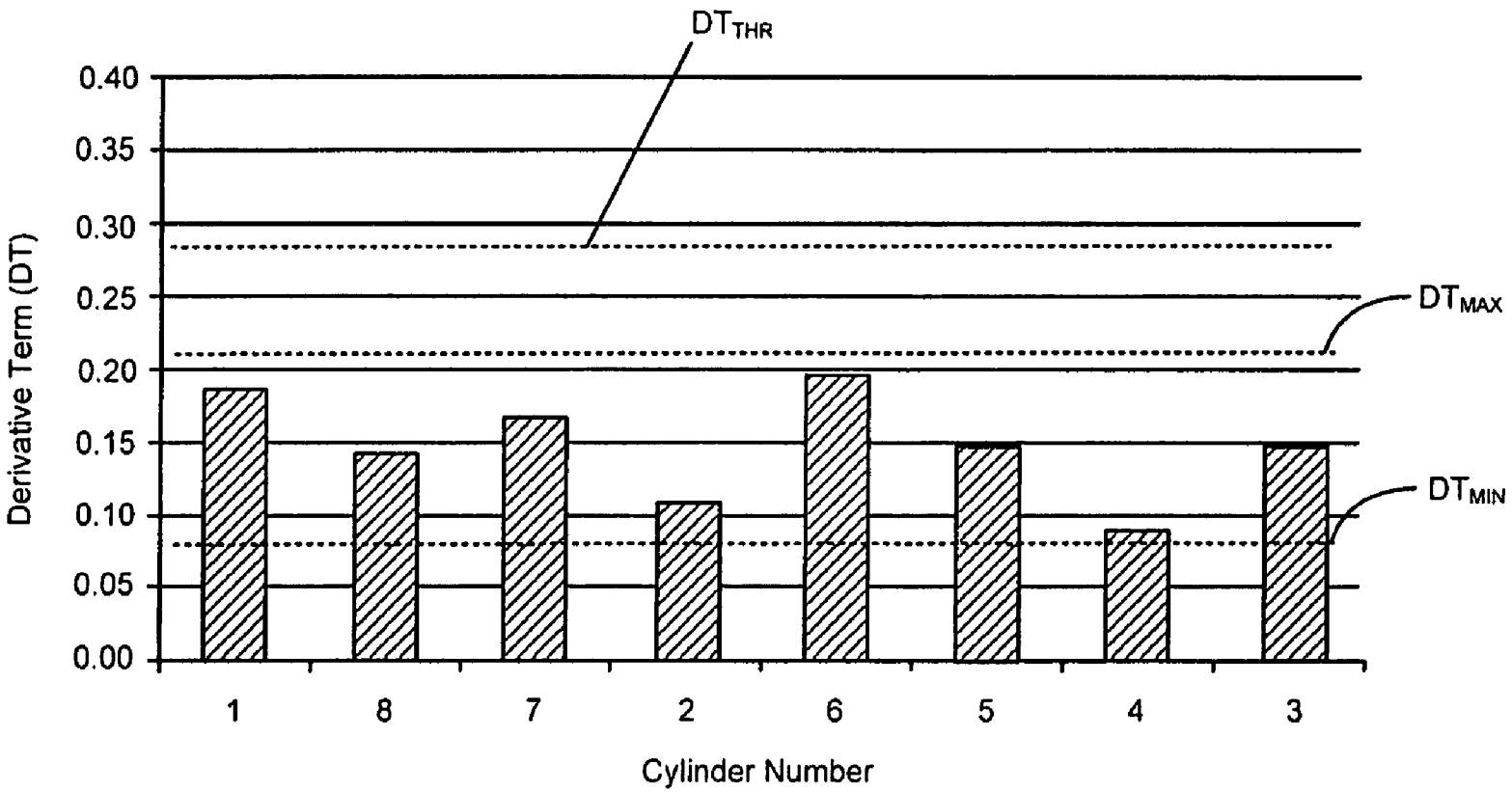
FIG. 3 is a graph illustrating active balancing of the torque output across the cylinders based on the derivative term magnitudes.

Referring now to FIG. 3, a graph illustrates active balancing of the torque output of the cylinder with respect to the total torque output across the cylinders. As illustrated, $DT_{AVG}$ for each cylinder is balanced so that it is within a predetermined range defined between $DT_{MIN}$ and $DT_{MAX}$. $DT_{MAX}$ is established to be sufficiently below $DT_{THR}$.

Figure 4:
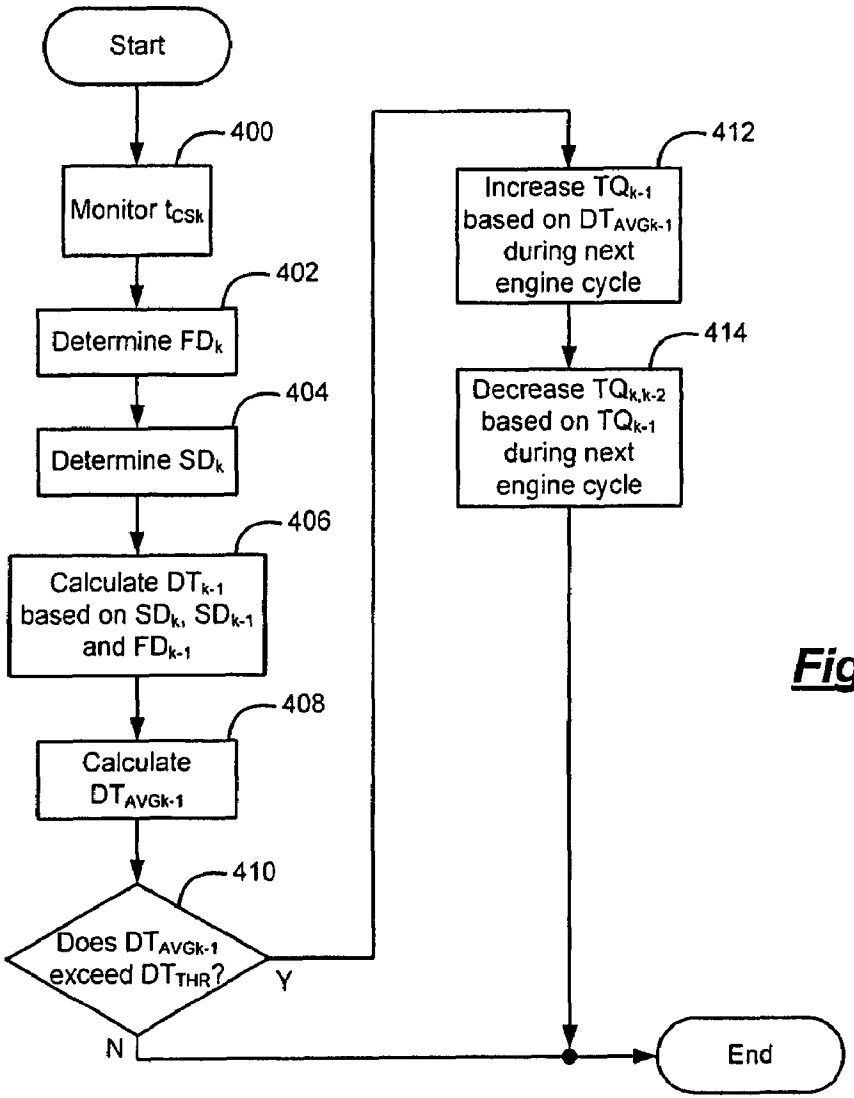
FIG. 4 is a flowchart illustrating exemplary steps executed by the cylinder torque balancing control of the present invention.

Referring now to FIG. 4, exemplary steps executed by the cylinder torque balancing control will be described in detail. In step 400, control monitors $t_{CSk}$ for the recovery cylinder. In steps 402 and 404, control determines $FD_k$ and $SD_k$, respectively. Control determines $DT_{k-1}$ (i.e., for the monitored cylinder) based on $SD_k$, $SD_{k-1}$ and $FD_{k-1}$, in step 406. $SD_{k-1}$, and $FD_{k-1}$, are provided from a buffer and are determine in a previous iteration. In step 408, control determines $DT_{AVGk-1}$ (i.e., $DT_{AVG}$ for the monitored cylinder k-1) based on $DT_{k-1}$.

In step 410, control determines whether $DT_{AVGk-1}$ (i.e., for the currently firing cylinder) exceeds $DT_{THR}$. If $DT_{AVGk-1}$ does not exceed $DT_{THR}$, control ends. If $DT_{AVGk-1}$ exceeds $DT_{THR}$, control increases $TQ_{k-1}$, based on $DT_{AVGk-1}$, during the next firing event for the monitored cylinder k-1 in step 412. In step 414, control increases TQ for either or both of the previous firing cylinder k-2 and the recovery cylinder k based on the increase to $TQ_{k-1}$, and control ends.

Figure 5:
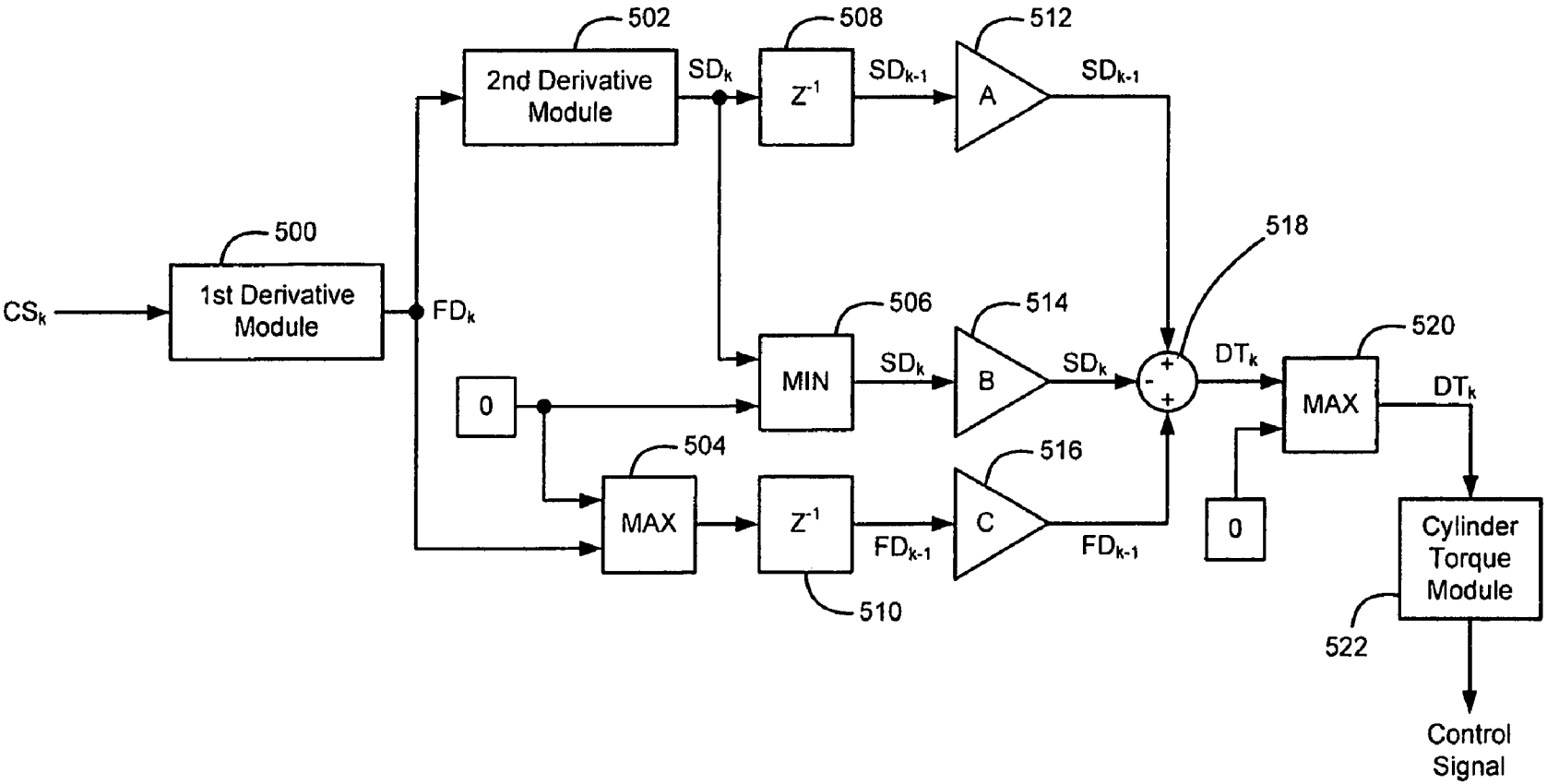
FIG. 5 is a functional block diagram illustrating exemplary modules that execute the cylinder torque balancing control of the present invention.

Referring now to FIG. 5, exemplary modules that execute the cylinder torque balancing control will be described in detail. The exemplary modules include first and second derivative modules 500, 502, maximum and minimum modules 504, 506, buffer modules 508, 510, gain modules 512, 514, 516, a summer 518, a maximum module 520 and a cylinder torque module 522. The first derivative module 500 receives $t_{CSk}$ and determines $FD_k$ based thereon. $FD_k$ is output to the second derivative module 502 and the maximum module 504. The second derivative module 502 determines $SD_k$ based on $FD_k$ and outputs $SD_k$ to the minimum module 506 and the buffer module 508.

The maximum module 504 clamps $FD_k$ and the minimum module 506 clamps $SD_k$ to minimize noise. The buffer modules 508, 510 output $SD_{k-1}$, and $FD_{k-1}$ to the gain modules 512, 516, respectively, and the minimum module 506 outputs $SD_k$ to the gain module 514. The gain modules 512, 514, 516 multiply $SD_{k-1}$, $SD_k$ and $FD_{k-1}$, by respective gains A, B and C. The gains can be used to adjust the influence or weight of a particular derivative (i.e., $SD_{k-1}$, $SD_k$ and $FD_{k-1}$) or to turn OFF a derivative (e.g., gain set equal to 0).

The summer 518 sums $FD_{k-1}$, and $SD_{k-1}$ and subtracts $SD_k$ to provide $DT_{k-1}$. $DT_{k-1}$ is output to the maximum module 520, which clamps $DT_{k-1}$ to minimize noise. $DT_{k-1}$ is output to the cylinder torque module 522, which calculates $DT_{AVG}$ for each cylinder and generates control signals to regulate the torque output of the individual cylinders.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine torque control system for balancing torque output of cylinders of an internal combustion engine, comprising:

a first module that determines a derivative term for each cylinder of said engine based on rotation of a crankshaft; and a second module that determines a torque correction for a first cylinder based on an average derivative term associated with said first cylinder, that adjusts a torque output of said first cylinder based on said torque correction and that adjusts a torque output of a second cylinder based on said torque correction.

2. The engine torque control system of claim 1 wherein said second module compares said average derivative term to a derivative term threshold and adjusts said torque output when said average derivative term exceeds said derivative term threshold.

3. The engine torque control system of claim 1 further comprising:

a third module that determines a first derivative based on said rotation of said crankshaft; and a fourth module that determines a second derivative based on said first derivative term;

wherein said average derivative term is determined based on said first and second derivatives.

4. The engine torque control system of claim 1 wherein said average derivative term is determined based on a first derivative that is determined for said first cylinder, a second derivative that is determined for said first cylinder and another second derivative that is determined for a recovery cylinder that is immediately after said first cylinder in a firing order.

5. The engine torque control system of claim 1 wherein said second module adjusts said torque output by increasing a torque output of said first cylinder.

6. The engine torque control system of claim 5 wherein said torque output of said second cylinder is decreased in correspondence with a torque increase of said first cylinder.

7. The engine torque control system of claim 1 wherein said second module increases a torque output of said first cylinder by an increase torque amount, decreases a torque output of said second cylinder by a first decrease torque amount and decreases a torque output of a third cylinder by a second decrease torque amount, wherein a total of said first and second decrease torque amounts corresponds to said increase torque amount.

8. The engine torque control system of claim 1 wherein said second module calculates a spark timing based on said average derivative term and induces combustion in said first cylinder based on said spark timing.

9. The engine torque control system of claim 8 wherein said spark timing is further based on a spark versus thermal efficiency curve of said engine.

10. The engine torque control system of claim 1 wherein said second module adjusts said torque output by regulating a fueling rate to said first cylinder.

11. A method of balancing torque output of cylinders of an internal combustion engine, comprising:

monitoring a crankshaft rotation;

determining a derivative term for each cylinder of said engine;

determining a torque correction for a first cylinder based on said derivative term; and adjusting a torque output of said first cylinder based on said torque correction and adjusting a torque output of a second cylinder based on said torque correction.

12. The method of claim 11 further comprising:

comparing each derivative term to a derivative term threshold; and adjusting said torque output when said derivative term exceeds said derivative term threshold.

13. The method of claim 11 wherein said derivative term is determined based on first and second derivatives that are determined for said first cylinder and a second derivative that is determined for a recovery cylinder that is immediately after said first cylinder in a firing order.

14. The method of claim 11 wherein said step of adjusting includes increasing a torque output of said first cylinder.

15. The method of claim 14 wherein said torque output of said second cylinder is decreased in correspondence with a torque increase of said first cylinder.

16. The method of claim 11 wherein said step of adjusting comprises:

increasing a torque output of said first cylinder by an increase torque amount;

decreasing a torque output of said second cylinder by a first decrease torque amount; and decreasing a torque output of a third cylinder by a second decrease torque amount, wherein a total of said first and second decrease torque amounts corresponds to said increase torque amount.

17. The method of claim 11 wherein said step of adjusting comprises:

calculating a spark timing based on said derivative term; and inducing combustion in said first cylinder based on said spark timing.

18. The method of claim 17 wherein said spark timing is further based on a spark versus thermal efficiency curve of said engine.

19. The method of claim 11 wherein said step of adjusting includes regulating a fueling rate to said first cylinder.

20. An engine torque control system for balancing torque output across cylinders of an internal combustion engine, comprising:

a first module that determines a first derivative for each cylinder of said engine based on rotation of a crankshaft and that determines a second derivative for each cylinder based on their respective first derivatives; and a second module that determines an average derivative term for each cylinder based on their respective first and second derivatives and that adjusts a torque output of said cylinders based on their respective average derivative terms to balance said average derivative terms with respect to one another.

21. The engine torque control system of claim 20 wherein said second module adjusts said torque output to maintain each of said average derivative terms within a range defined between a maximum and a minimum derivative term.

22. The engine torque control system of claim 20 wherein said first and second derivatives correspond to a first cylinder and further comprising a fifth module that determines a second derivative of a recovery cylinder, wherein said average derivative term is further based on said second derivative of said recovery cylinder.

23. The engine torque control system of claim 20 wherein said second module adjusts said torque output by increasing a torque output of a first cylinder.

24. The engine torque control system of claim 23 wherein a torque output of a second cylinder is decreased in correspondence with said torque increase of said first cylinder.

25. The engine torque control system of claim 20 wherein said second module increases a torque output of a first cylinder by an increase torque amount, decreases a torque output of a second cylinder by a first decrease torque amount and decreases a torque output of a third cylinder by a third decrease torque amount, wherein a total of said first and second decrease torque amounts corresponds to said increase torque amount.

26. The engine torque control system of claim 20 wherein said second module calculates spark timings of said cylinders based on said average derivative terms and induces combustion in said cylinder based on said spark timings.

27. The engine torque control system of claim 26 wherein said spark timing is further based on a spark versus thermal efficiency curve of said engine.

28. The engine torque control system of claim 20 wherein said second module adjusts said torque output by regulating a fueling rate to said cylinders.

29. A method of balancing torque output of cylinders of an internal combustion engine, comprising:

determining a first derivative for each cylinder of said engine based on rotation of a crankshaft;

determining a second derivative for each cylinder based on their respective first derivatives;

determining an average derivative term for each cylinder based on their respective first and second derivatives; and adjusting a torque output of said cylinders based on their respective average derivative terms to balance said average derivative terms with respect to one another.

30. The method of claim 29 wherein said adjusting comprises regulating said torque output to maintain each of said average derivative terms within a range defined between a maximum and a minimum derivative term.

31. The method of claim 29 wherein said first and second derivatives correspond to a first cylinder and further comprising determining a second derivative of a recovery cylinder, wherein said average derivative term is further based on said second derivative of said recovery cylinder.

32. The method of claim 29 wherein said adjusting comprises increasing a torque output of a first cylinder.

33. The method of claim 32 wherein a torque output of a second cylinder is decreased in correspondence with said torque increase of said first cylinder.

34. The method of claim 29 wherein said adjusting comprises:

increasing a torque output of a first cylinder by an increase torque amount;

decreases a torque output of a second cylinder by a first decrease torque amount; and decreasing a torque output of a third cylinder by a third decrease torque amount, wherein a total of said first and second decrease torque amounts corresponds to said increase torque amount.

35. The method of claim 29 further comprising:

calculating spark timings of said cylinders based on said average derivative terms; and inducing combustion in said cylinder based on said spark timings.

36. The method of claim 35 wherein said spark timing is further based on a spark versus thermal efficiency curve of said engine.

37. The method of claim 29 wherein said adjusting comprises regulating a fueling rate to said cylinders.

* * * * *